US010381733B2

(12) United States Patent
Hwang et al.

(10) Patent No.: US 10,381,733 B2
(45) Date of Patent: Aug. 13, 2019

(54) MULTI-BAND PATCH ANTENNA MODULE

(71) Applicant: AMOTECH CO., LTD., Incheon (KR)

(72) Inventors: Chul Hwang, Incheon (KR); In-Jo Jeong, Incheon (KR); Sang-O Kim, Incheon (KR); Dong-Hwan Koh, Seoul (KR)

(73) Assignee: AMOTECH CO., LTD., Incheon (KR)

( * ) Notice: Subject to any disclaimer, the term of this patent is extended or adjusted under 35 U.S.C. 154(b) by 0 days.

(21) Appl. No.: 15/750,767

(22) PCT Filed: Oct. 26, 2016

(86) PCT No.: PCT/KR2016/012102

§ 371 (c)(1),
(2) Date: Feb. 6, 2018

(87) PCT Pub. No.: WO2017/074033

PCT Pub. Date: May 4, 2017

(65) Prior Publication Data

US 2018/0241127 A1 Aug. 23, 2018

(30) Foreign Application Priority Data

Oct. 26, 2015 (KR) ..... 10-2015-0149013

(51) Int. Cl.

| | |
|---|---|
| ***H01Q 9/04*** | (2006.01) |
| ***H01Q 1/24*** | (2006.01) |
| ***H01Q 9/42*** | (2006.01) |
| ***H01Q 5/30*** | (2015.01) |
| ***H01Q 1/22*** | (2006.01) |
| ***H01Q 5/378*** | (2015.01) |

(52) U.S. Cl.

CPC ..... *H01Q 9/0421* (2013.01); *H01Q 1/2291* (2013.01); *H01Q 1/24* (2013.01);
(Continued)

(58) Field of Classification Search
None
See application file for complete search history.

(56) References Cited

U.S. PATENT DOCUMENTS 6,104,348 A * 8/2000 Karlsson ..... H01Q 1/246 343/700 MS
6,225,959 B1 * 5/2001 Gordon ..... H01Q 13/103 343/700 MS (Continued)

FOREIGN PATENT DOCUMENTS

CN 102842756 A 12/2012
JP 2006-094349 A 4/2006

(Continued)

OTHER PUBLICATIONS

Office Action issued in Chinese Application No. 201680048317.X, dated May 17, 2019.

*Primary Examiner* — Trinh V Dinh
(74) *Attorney, Agent, or Firm* — Baker & Hostetler LLP

(57) ABSTRACT

Disclosed is a multi-band patch antenna module, which forms an inner radiation patch having different horizontal and vertical lengths and an outer radiation patch spaced from the inner radiation patch on one surface of a dielectric layer, and transmits and receives signals of a 2.4 GHz band and a 5 GHz band. The multi-band patch antenna module disclosed includes the dielectric layer, the outer radiation patch formed with an insertion hole and formed on one surface of the dielectric layer, and the inner radiation patch inserted into the insertion hole and formed on one surface of the dielectric layer; and a horizontal length of the inner radiation patch is different from a vertical length of the inner radiation patch.

6 Claims, 11 Drawing Sheets

(52) U.S. Cl.
CPC ..... *H01Q 5/30* (2015.01); *H01Q 5/378* (2015.01); *H01Q 9/045* (2013.01); *H01Q 9/42* (2013.01)

(56) References Cited

U.S. PATENT DOCUMENTS

| | | | | |
|---|---|---|---|---|
| 7,034,753 | B1 * | 4/2006 | Elsallal | H01Q 21/0006 343/700 MS |
| 7,129,899 | B2 * | 10/2006 | Jecko | H01Q 9/0421 343/702 |
| 2005/0134508 | A1 * | 6/2005 | Ueda | H01Q 9/0414 343/700 MS |
| 2006/0097924 | A1 * | 5/2006 | Yegin | H01Q 9/0407 343/700 MS |
| 2007/0296635 | A1 * | 12/2007 | Popugaev | H01Q 9/0414 343/700 MS |
| 2009/0153404 | A1 * | 6/2009 | Ryou | H01Q 9/0407 343/700 MS |
| 2009/0303143 | A1 * | 12/2009 | Miyoshi | H01Q 9/0414 343/728 |

FOREIGN PATENT DOCUMENTS

| | | | |
|---|---|---|---|
| KR | 10-2008-0002174 | A | 1/2008 |
| KR | 10-2009-0051866 | A | 5/2009 |
| KR | 10-2012-0052784 | A | 5/2012 |
| KR | 10-2013-0017274 | A | 2/2013 |
| KR | 20160017274 | A | 2/2016 |

* cited by examiner

| Frequency [MHz] | Return loss (Return Loss) [-dB] | band width @ -10dB[MHz] |
|---|---|---|
| 2400.0 | 13.7 | - |
| 2442.5 | 7.8 | |
| 2485.0 | 5.8 | |
| 5150.0 | 18.6 | 1293MHz |
| 5500.0 | 14.3 | |
| 5850.0 | 11.9 | |

FIG. 7

| Frequency [MHz] | Return loss (Return Loss) [-dB] | band width @ -10dB[MHz] |
|---|---|---|
| 2400.0 | 13.7 | - |
| 2442.5 | 7.8 | |
| 2485.0 | 8.1 | |
| 5150.0 | 6.5 | 575MHz |
| 5500.0 | 8.3 | |
| 5850.0 | 22.1 | |

FIG. 9

| Frequency [MHz] | Return loss (Return Loss) [-dB] | band width@ -10dB[MHz] |
|---|---|---|
| 2400.0 | 10.6 | - |
| 2442.5 | 7.8 | |
| 2485.0 | 6.4 | |
| 5150.0 | 11.9 | 415MHz |
| 5500.0 | 0.51 | |
| 5850.0 | 9.1 | |

FIG. 11

MULTI-BAND PATCH ANTENNA MODULE

CROSS-REFERENCE TO THE RELATED APPLICATIONS

This application is a National Stage of International Application No. PCT/KR2016/012102, filed Oct. 26, 2016, which claims priority from Korean Patent Application No. 10-2015-0149013, filed on Oct. 26, 2015 in the Korean Intellectual Property Office, the disclosure of which are incorporated herein by reference in their entirety.

TECHNICAL FIELD

The present disclosure relates to a multi-band patch antenna module, and more particularly, to a multi-band patch antenna module receiving a frequency at a 2.4 GHz band and a 5 GHz band used for a Wi-Fi band.

BACKGROUND ART

As a wireless communication technology develops, popularization of telecommunication terminals, such as a mobile phone, a PDA, a GPS receiver, and a navigator has become possible. These telecommunication terminals are mainly used with a patch antenna, which is a small-sized and lightweight and is thinly produced with a flat surface type.

Generally, the patch antenna is formed to have a resonance characteristic in a frequency band of GPS, SDARS and the like. The patch antenna is formed with a multi-band antenna for occupying a mounted space. That is, the patch antenna is formed with radiation patches operating by each band antenna on one surface of a dielectric material, and formed to resonate at a frequency for each characteristic.

Since a conventional patch antenna is used for a frequency of GPS, SDARS and the like, a radiation patch positioned therein is formed with the square shape having a ratio of a horizontal length and a vertical length being 1:1.

Meanwhile, in order to configure a home network via communication between a recent mobile terminal and an electronic device (for example, a refrigerator, a camera, a TV, an audio and the like), a wireless communication module is mounted on the mobile terminal and the electronic device.

In configuring the home network, the wireless communication between the mobile terminal and the electronic device is mainly used with Wi-Fi. The Wi-Fi is classified into a 2.4 GHz band, which is characterized by a relatively wide communication radius, and a 5 GHz band, which is characterized by a fast transmission speed in a relatively short radius.

In configuring the initial home network, the 2.4 GHz band having a wide communication radius is mainly used, but there is a problem in that a signal error occurs due to a signal interference by a router, a Bluetooth and the like.

Due to such a problem, recently in configuring the home network, the 5 GHz band having a relatively little signal interference is used.

Accordingly, a need for the electronic device and the mobile terminal serving all of two bands (that is, 2.4 GHz and 5 GHz) is on the rising.

Conventionally, in order to serve Wi-Fi of two bands, antennas for each frequency band should be mounted on the mobile terminal and the electronic device.

However, there is a problem in that in order to mount all of two antennas, a relatively wide mounted space is needed, and thus it is difficult to mount all of the antennas for two bands on the mobile terminal and the electronic device, which are miniaturization trends.

DISCLOSURE

Technical Problem

The present disclosure is proposed to solve the above problems, and an object of the present disclosure is to provide a multi-band patch antenna module, which forms an inner radiation patch having different horizontal and vertical lengths and an outer radiation patch spaced from the inner radiation patch on one surface of a dielectric layer, and transmits and receives signals of a 2.4 GHz band and a 5 GHz band.

Technical Solution

For achieving the object, a multi-band patch antenna module in accordance with an embodiment of the present disclosure includes a dielectric layer, an outer radiation patch formed with an insertion hole, and formed on one surface of the dielectric layer, and an inner radiation patch inserted into the insertion hole, and formed on one surface of the dielectric layer; and a horizontal length of the inner radiation patch is different from a vertical length of the inner radiation patch.

The inner radiation patch can be a rectangular shape, and the vertical length with respect to the horizontal length can be equal to or smaller than 0.95.

The inner radiation patch can be formed with one or more protrusion portion extended in an outside direction from at least one side thereof, and the protrusion portion can be formed on adjacent three sides among four sides thereof, respectively.

The inner radiation patch can be formed with a feeding hole; the feeding hole can be formed to be spaced from a center point of the inner radiation patch; and the dielectric layer can be formed with another feeding hole on a location corresponding to the feeding hole, which is formed on the inner radiation patch.

The outer radiation patch can be the frame shape having the same horizontal length and the vertical length. In this case, the outer radiation patch can be formed with a protrusion portion extended in an outside direction from at least one side thereof, and the protrusion portion can be formed on a side of the outer radiation patch corresponding to a side on which a protrusion portion is formed among four sides of the inner radiation patch.

Advantageous Effects

In accordance with the present disclosure, by providing a multi-band patch antenna module that forms an inner radiation patch differently forming a horizontal length and a vertical length on one surface of a dielectric material and an outer radiation patch spaced from the inner patch antenna, there is the effect that can transmit and receive all signals of 2.4 GHz band and 5 GHz band used for a Wi-Fi band via one patch antenna.

Further, by providing the multi-band patch antenna module that serves the 2.4 GHz band and the 5 GHz band via one patch antenna, there is the effect that can minimize a mounted space compared to the conventional antenna module mounted for each band (that is, the 2.4 GHz band and the 5 GHz band).

Further, since the band width of the 5 GHz band in the multi-band patch antenna module increases by two or more compared to the conventional patch antenna module, it is possible to minimize Wi-Fi seamless phenomenon, thus maintaining a stable Wi-Fi connection.

Further, since the band width of the 5 GHz band in the multi-band patch antenna module increases compared to the conventional patch antenna module, in the multi-band patch antenna module, it is possible to increase the frequency band that can be set as a band width, thus minimizing a frequency interference with another device of the 5 GHz band.

DESCRIPTION OF DRAWINGS

FIGS. 6 to 11 are views explaining comparison of antenna characteristics of the multi-band patch antenna module in accordance with the embodiment of the present disclosure and a conventional patch antenna module.

MODE FOR INVENTION

Figure 1:
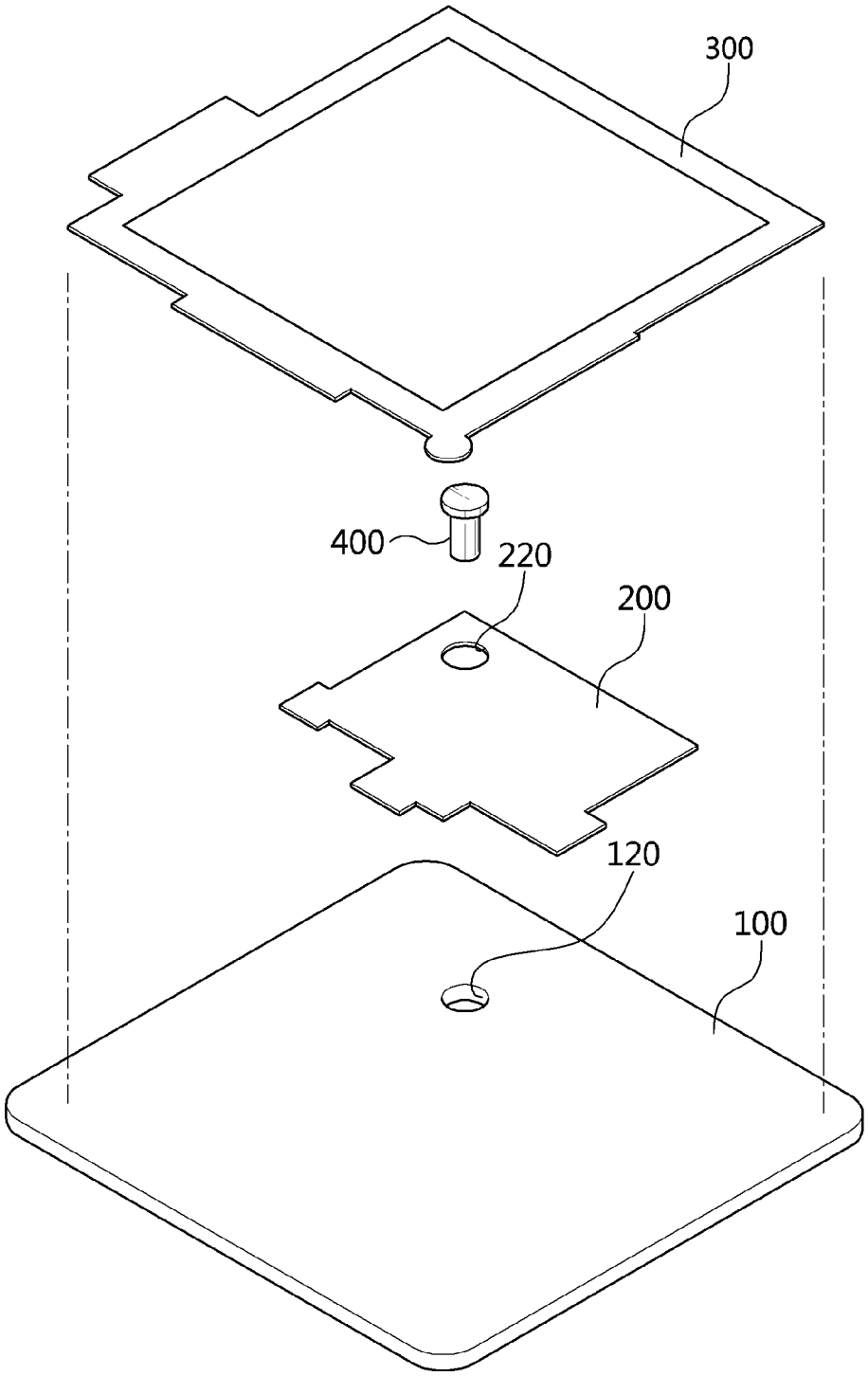
FIG. 1 is a view explaining a multi-band patch antenna module in accordance with an embodiment of the present disclosure.

Hereinafter, for detailed explanation to the extent that a person skilled in the art to which the present disclosure pertains can easily embody the technical spirit of the present disclosure, the most preferred embodiments of the present disclosure will be described in detail with reference to the accompanying drawings. First, it should be noted that in denoting reference numerals to the elements in each drawing, the same elements have the same reference numerals if possible even though illustrated in different drawings. Further, in explaining the present disclosure, detailed description of related known configurations and functions will be omitted if it obscures the subject matter of the present disclosure.

Referring to FIG. 1, a multi-band patch antenna module in accordance with an embodiment of the present disclosure includes a dielectric layer 100, an inner radiation patch 200, and an outer radiation patch 300.

The dielectric layer 100 is installed on the lowest portion of the multi-band patch antenna module. The dielectric layer 100 can be generally used with a ceramic having the characteristics, such as a high dielectric constant and a low thermal expansion coefficient, and a hole (not shown) for connection with the inner radiation patch 200 and the outer radiation patch 300 can be also formed.

Figure 2:
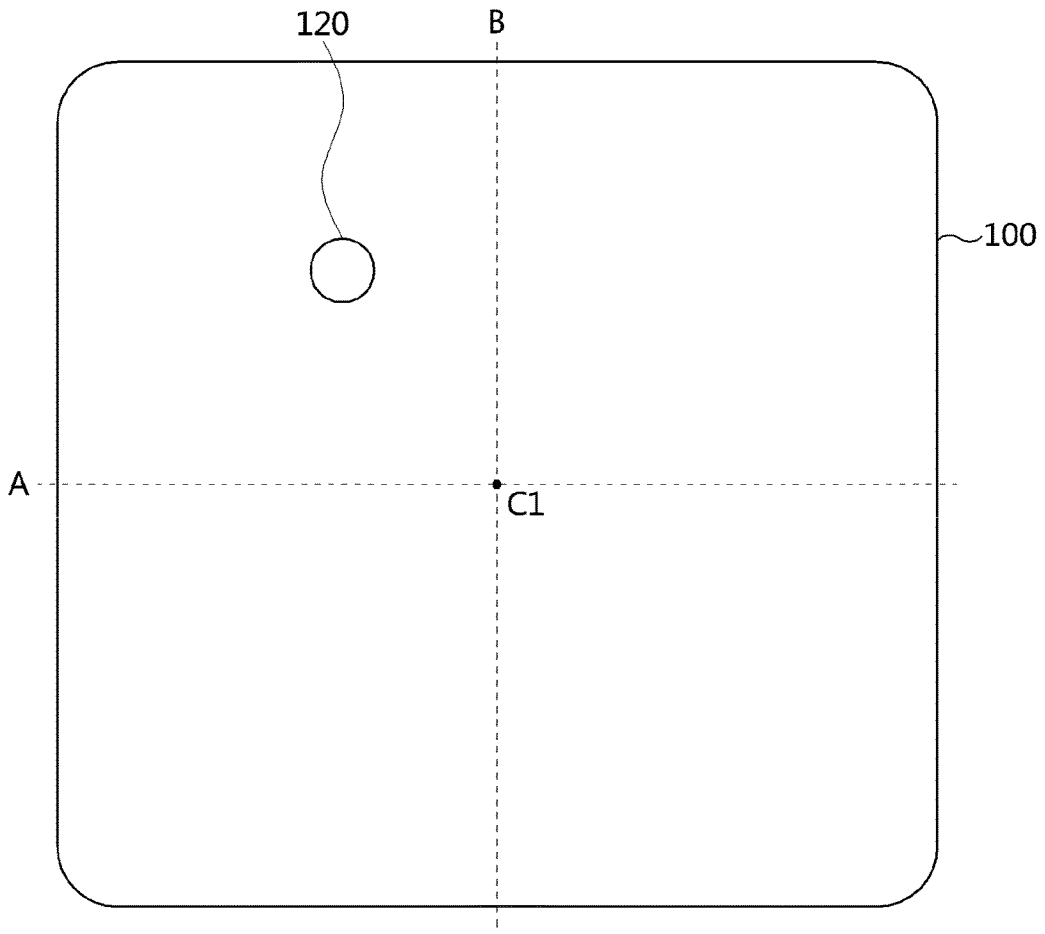
FIG. 2 is a view explaining a dielectric layer of FIG. 1.

Referring to FIG. 2, the dielectric layer 100 can be formed with a through-hole 120 into which a feeding pin 400 electrically connecting the inner radiation patch 200 and a feeding line (not shown) is inserted. The through-hole 120 is formed in the area, in which the inner radiation patch 200 is formed, among the whole area of the dielectric layer 100.

In this case, the through-hole 120 is formed to be spaced at a predetermined interval in an outer circumferential direction from a center point C1 of the dielectric layer 100. The through-hole 120 is formed on any one of four areas divided by two virtual lines A, B crossing at the center point C1 of the dielectric layer 100.

Herein, in the case that the dielectric layer 100 is connected with the feeding line and the inner radiation patch 200 through a coaxial cable, a feeding hole, a feeding patch and the like, formation of the through-hole 120 can be also omitted.

The inner radiation patch 200 is formed on an upper surface of the dielectric layer 100. The inner radiation patch 200, as a radiation portion resonating at the 5 GHz band in a Wi-Fi frequency band, is formed to have at least part thereof overlapped with the center point of the dielectric layer 100. The inner radiation patch 200 is composed of a thin plate of a conductive material having a high conductivity, such as copper, aluminum, gold, and silver.

Figure 3:
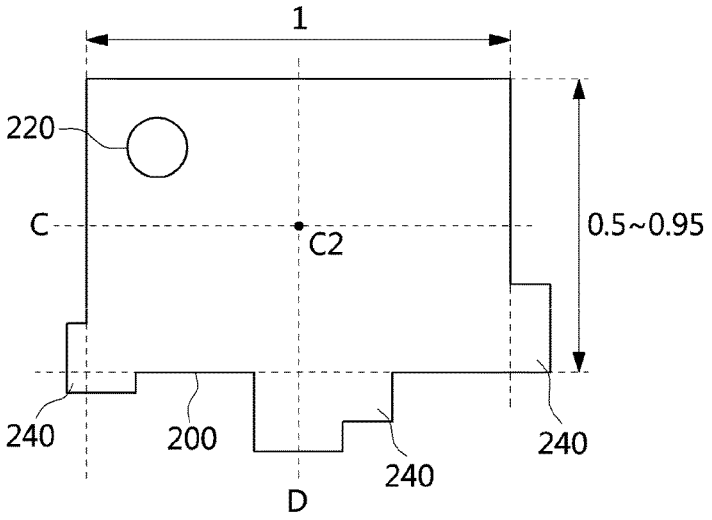
FIG. 3 is a view explaining an inner radiation patch of FIG. 1.

In this case, referring to FIG. 3, the inner radiation patch 200 is formed with the rectangular shape having a different ratio of the horizontal length (X) and the vertical length (Y). That is, since a conventional patch antenna is mainly used for transmitting and receiving a signal of the frequency band, such as GPS and SDARS, the inner patch antenna is composed of the square having a ratio of the horizontal length and the vertical length being about 1:1.

However, since the multi-band patch antenna module in accordance with an embodiment of the present disclosure is used for transmitting and receiving a signal of the 5 GHz band in the Wi-Fi band, it is impossible to obtain necessary performance in case of using the inner patch antenna having the square shape.

Accordingly, the inner radiation patch 200 is differently formed in the horizontal length (X) and the vertical length (Y). The inner radiation patch 200 is formed with the rectangular shape having the vertical length (Y) with respect to the horizontal length (X) being equal to or smaller than about 0.95. In this case, it is possible to implement the highest antenna performance if the inner radiation patch 200 is formed to have the vertical length (Y) with respect to the horizontal length (X) being about 0.7 (that is, 8.7 mm in the horizontal length, 6.1 mm in the vertical length).

The inner radiation patch 200 can be formed with one or more protrusion portion 240 in an outer circumferential direction for frequency tuning. In this case, the protrusion portion 240 can be formed on adjacent three sides among four sides of the inner radiation portion 200.

The inner radiation patch 200 is connected with the feeding line (not shown) positioned on a lower surface of the dielectric layer 100. For this purpose, the inner radiation patch 200 is formed with a through-hole 220 on the same location as that of the through-hole 120 formed on the dielectric layer 100.

In this case, the through-hole 220 is formed to be spaced at a predetermined interval in an outside direction from a center point C2 of the inner radiation patch 200. The through-hole 220 is formed on any one of four areas divided by two virtual lines C, D crossing at the center point C2 of the inner radiation patch 200.

The through-hole 220 can be also formed on the location spaced at a predetermined interval from the center point C1 of the dielectric layer 100. That is, the through-hole 220 is formed to be spaced from the center point on any one area of four areas divided by two virtual lines A, B orthogonal to the center point C1 of the dielectric layer 100.

Herein, in the case that the through-hole 220, into which the feeding pin 400 electrically connecting the inner radiation patch 200 and the feeding line (not shown) is inserted, is connected with the feeding line through the feeding hole, formation of the through-hole 220 can be also omitted.

The outer radiation patch 300, as the radiation portion resonating at the 2.4 GHz band in the Wi-Fi band, is formed to be spaced from the inner radiation patch 200 on the upper surface of the dielectric layer 100. The outer radiation patch 300 is composed of a thin plate of a conductive material having a high conductivity, such as copper, aluminum, gold, and silver, and can be formed with a thin plate of the same material as that of the inner radiation patch 200.

Figure 4:
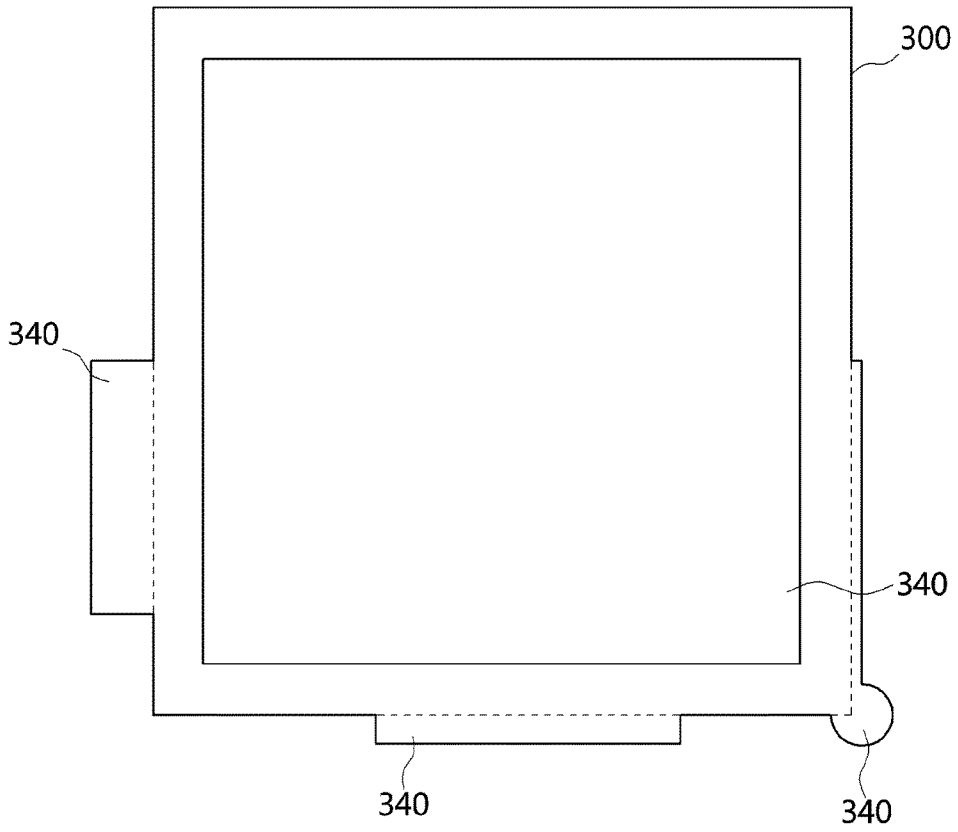
FIGS. 4 and 5 are views explaining an outer radiation patch of FIG. 1.

The outer radiation patch 300 is formed on the upper surface of the dielectric layer 100. In this case, referring to FIG. 4, the outer radiation patch 300 is formed with the donut shape having an insertion hole 320, into which the inner radiation patch 200 is inserted, formed.

The outer radiation patch 300 is formed with the frame shape (that is, the square shape) having the same horizontal length and vertical length, and formed with the insertion hoe 320 having the square shape therein. As the inner radiation patch 200 is inserted into the insertion hole 320, an inner circumference of the outer radiation patch 300 is spaced from an outer circumference of the inner radiation patch 200 at a predetermined interval. The outer radiation patch 300 is formed with the shape having the inner circumference spaced to surround the outer circumferential portion of the inner radiation patch 200.

The outer radiation patch 300 can be formed with one or more protrusion portion 340 in an outside direction for frequency tuning. In this case, the protrusion portion 340 can be formed on adjacent three sides among four sides of the outer radiation patch 300. Herein, the outer radiation patch 300 can be formed with the protrusion portion 340 on the sides corresponded to three sides of the inner radiation patch 200, on which the protrusion portion 240 is formed, among four sides thereof. Herein, the corresponded side means the closest side among the sides parallel with a side of the inner radiation patch 200.

Figure 5:
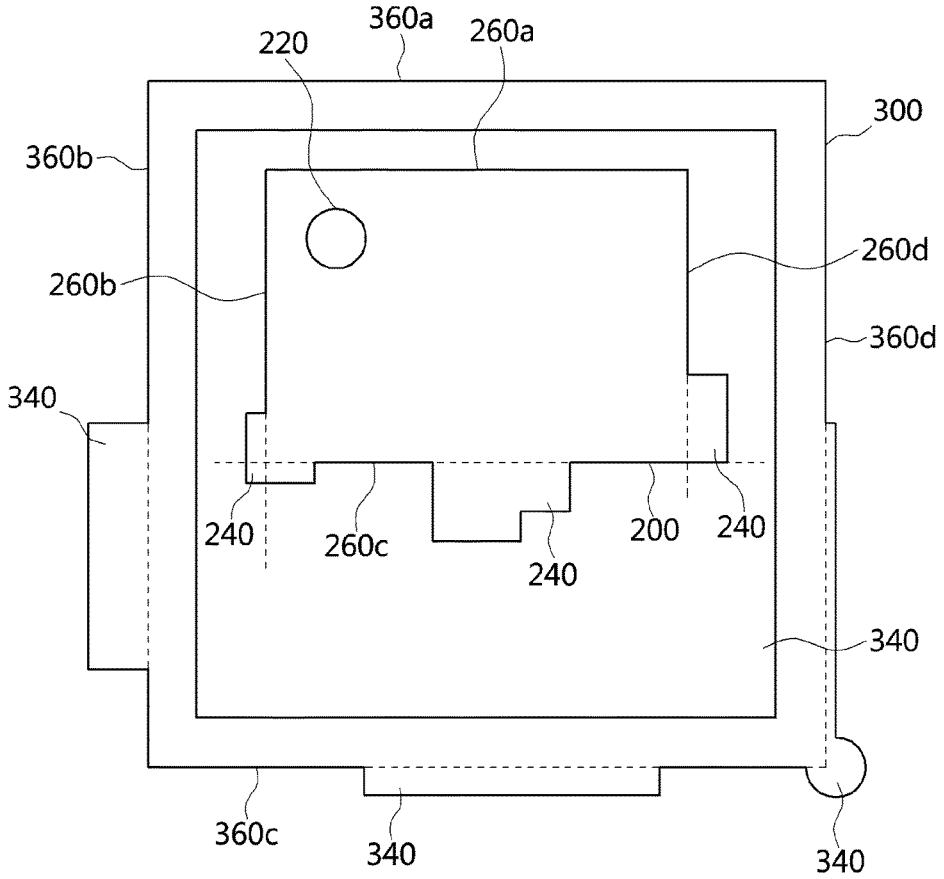

For example, referring to FIG. 5, in the case that the protrusion portion 240 is formed on adjacent three sides 260*b*, 260*c*, 260*d* among four sides 260*a*-260*d* of the inner radiation patch 200, the outer radiation patch 300 is formed with the protrusion portion 340 on the sides 360*b*, 360*c*, 360*d* corresponded to three sides 260*b*, 260*c*, 260*d* of the inner radiation patch 200, on which the protrusion portion 240 is formed, among four sides 360*a*-360*d* thereof.

A separated space between the inner circumference of the outer radiation patch 300 and the outer circumference of the inner radiation patch 200 forms a gap. Herein, the inner radiation patch 200 and the outer radiation patch 300 are formed with an electromagnetic coupling through the gap to thus implement a dual band at the 2.4 GHz band and the 5 GHz band which are a Wi-Fi frequency band. That is, through the electromagnetic coupling formed on the gap of the inner radiation patch 200 and the outer radiation patch 300, it is possible to implement the dual band by resonating at the Wi-Fi band of about 5 GHz in the inner radiation patch 200 and resonating at the Wi-Fi band of about 2.4 GHz in the outer radiation patch 300.

Figure 6:
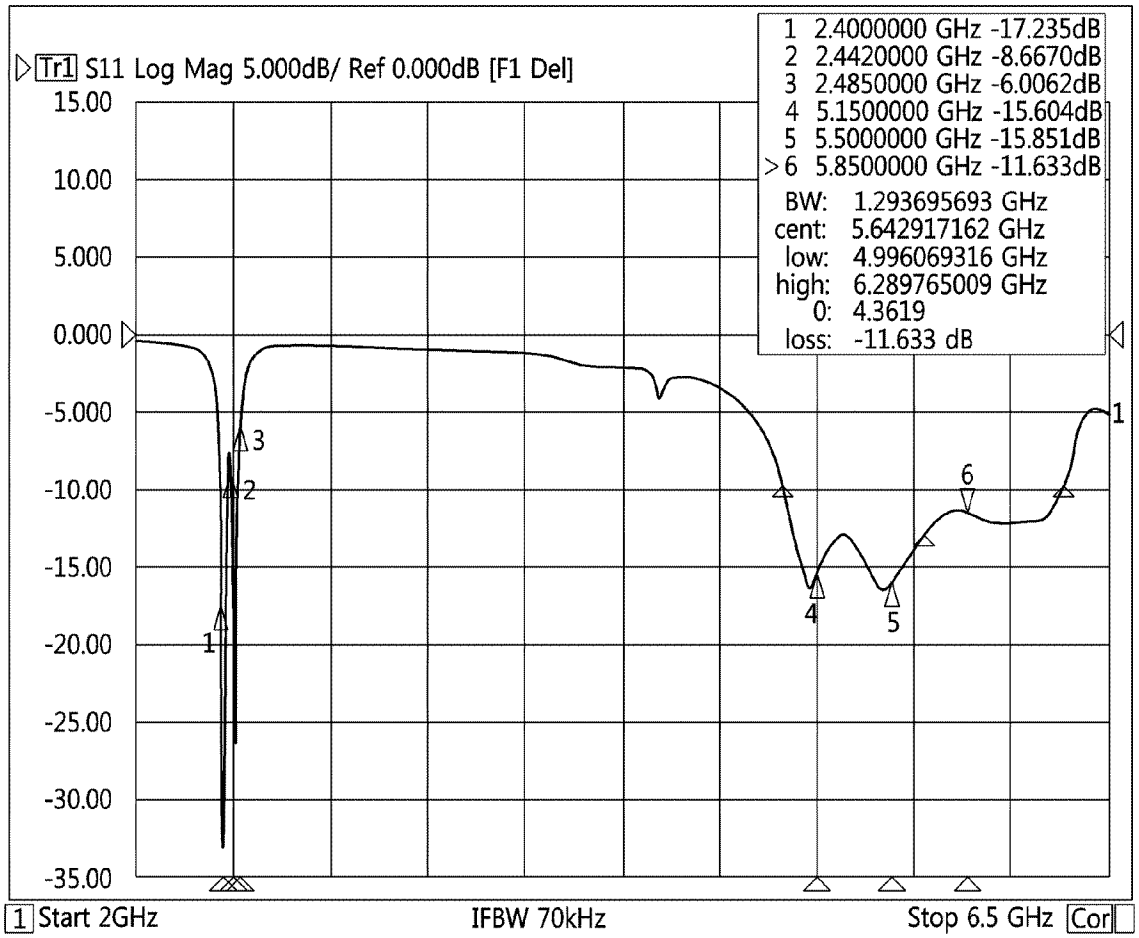

Referring to FIGS. 6 and 7, as the multi-band patch antenna module in accordance with an embodiment of the present disclosure is formed to have a ratio of the horizontal length and the vertical length of the inner radiation patch 200 being about 1:0.7 (that is, 8.7 mm in the horizontal length and 6.1 mm in the vertical length), the band width having return loss at the 2.4 GHz band maintained to be equal to or smaller than about −10 dB and having return loss at the 5 GHz band maintained to be equal to or smaller than about −10 dB forms about 1293 MHz.

Figure 8:
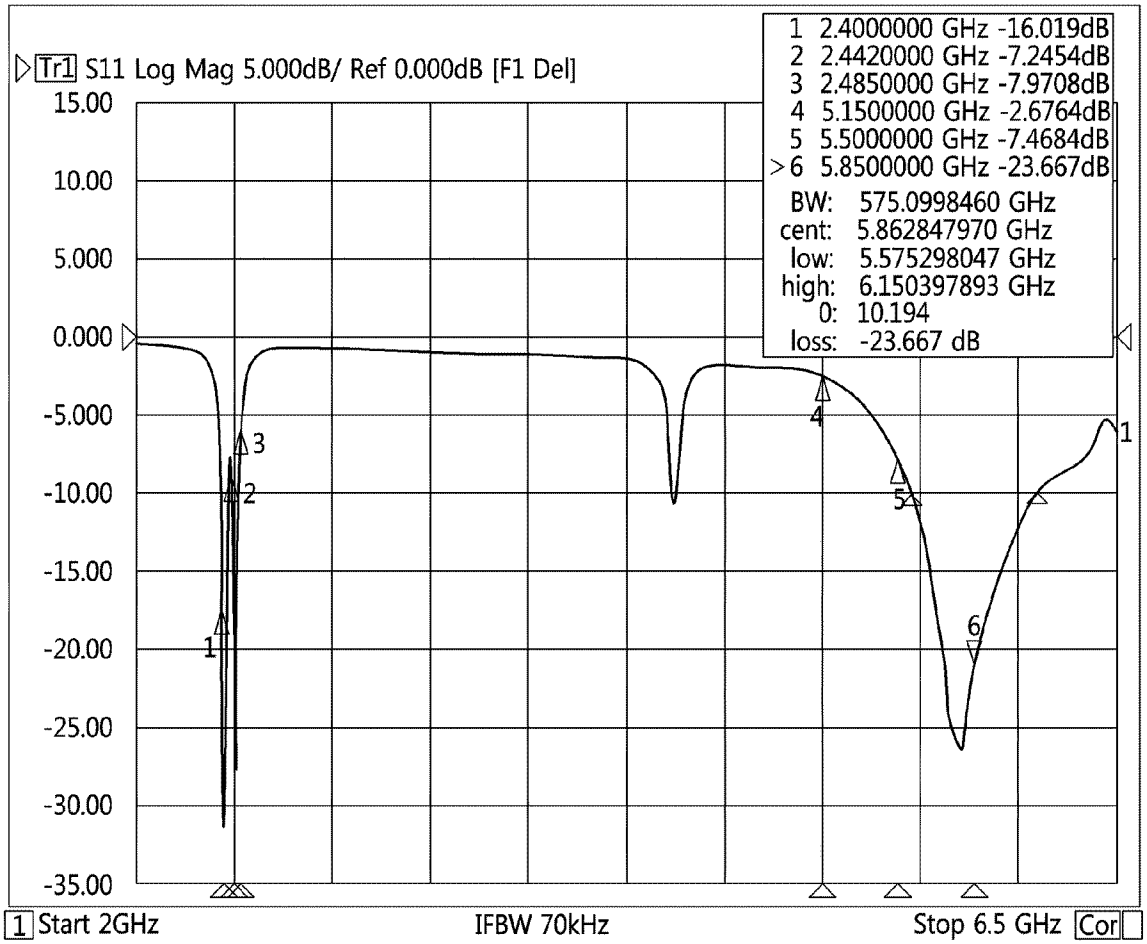

Referring to FIGS. 8 and 9, as the conventional patch antenna module is formed to have a ratio of the horizontal length and the vertical length of the inner radiation patch 200 being about 1:1 (that is, 7 mm in the horizontal length and 7 mm in the vertical length), the band width having return loss at the 2.4 GHz band maintained to be equal to or smaller than about −10 dB, but having return loss at the 5 GHz band maintained to be equal to or smaller than about −10 dB forms about 575 MHz.

Figure 10:
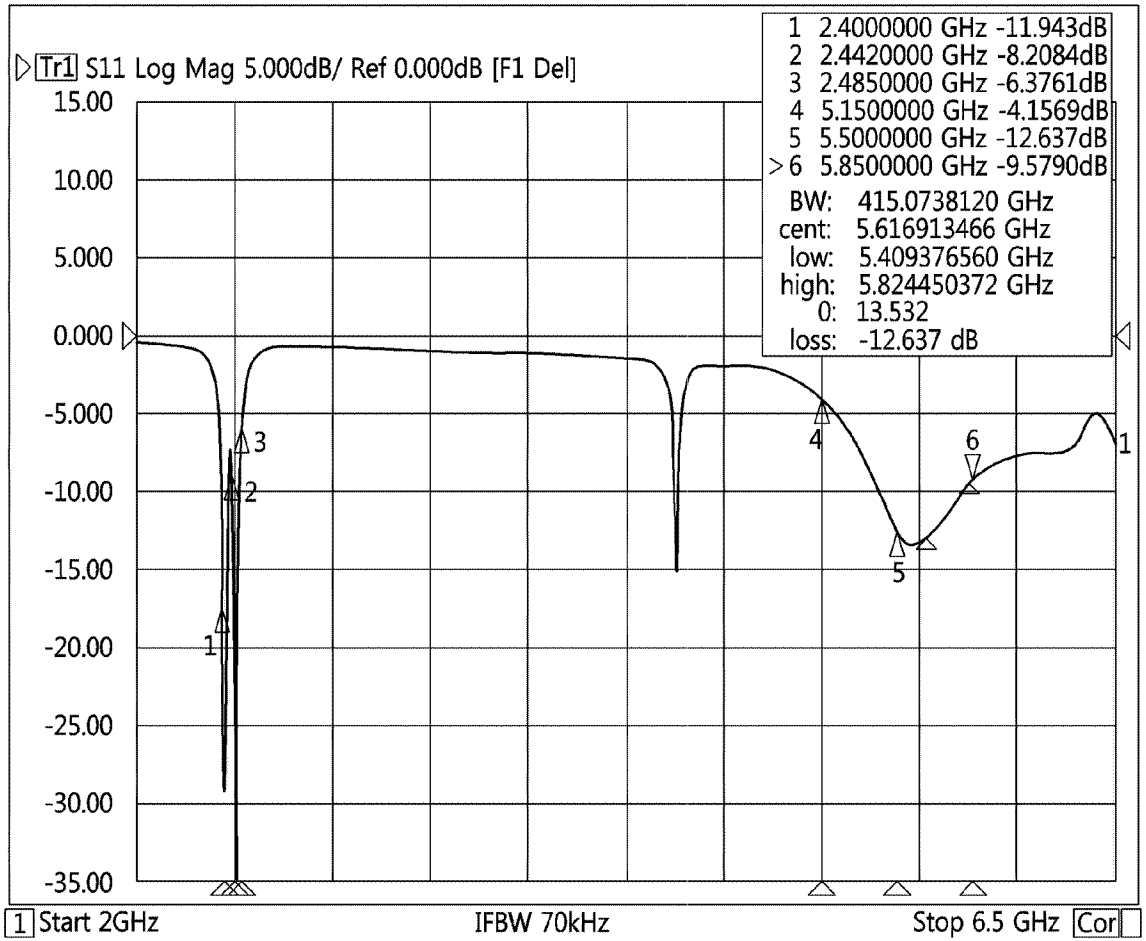

Referring to FIGS. 10 and 11, as the conventional patch antenna module is formed to have a ratio of the horizontal length and the vertical length of the inner radiation patch 200 being about 1:1 (that is, 8 mm in the horizontal length and 8 mm in the vertical length), the band width having return loss at the 2.4 GHz band maintained to be equal to or smaller than about −10 dB, but having return loss at the 5 GHz band maintained to be equal to or smaller than about −10 dB forms about 415 MHz.

As described above, since in the multi-band patch antenna module in accordance with an embodiment of the present disclosure, the band width of the 5 GHz band increases by two or more compared to the conventional patch antenna module, it is possible to minimize Wi-Fi seamless phenomenon, thus maintaining a stable Wi-Fi connection.

Further, since in the multi-band patch antenna module in accordance with an embodiment of the present disclosure, the band width of the 5 GHz band increases compared to the conventional patch antenna module, it is possible to increase the frequency band that can be set as a band width, thus minimizing a frequency interference with another device of the 5 GHz band.

While the present disclosure has been described with respect to the specific embodiments, it will be apparent to those skilled in the art that various changes and modifications may be made without departing from the spirit and scope of the disclosure as defined in the following claims.

The invention claimed is:

1. A multi-band patch antenna module, comprising:

a dielectric layer;

an outer radiation patch formed with an insertion hole, and formed on one surface of the dielectric layer; wherein the outer radiation patch comprises four sides among which a second side and a third side are adjacent to a first side, wherein at least one protrusion portion is extended in an outside direction on each of the first side, the second side and the third side of the outer radiation patch, and an inner radiation patch inserted into the insertion hole, and formed on one surface of the dielectric layer, wherein the inner radiation patch comprises four sides among which a second side and a third side are adjacent to a first side, wherein at least one protrusion portion is extended in an outside direction on each of the first side, the second side and the third side of the inner radiation patch, wherein a horizontal length of the inner radiation patch is different from a vertical length of the inner radiation patch, wherein the first side, the second side and the third side of the outer radiation patch correspond to the first side, the second side and the third side of the inner radiation patch, respectively.

2. The multi-band patch antenna module according to claim 1, wherein the inner radiation patch is a rectangular shape.

3. The multi-band patch antenna module according to claim 1, wherein the inner radiation patch has the vertical length with respect to the horizontal length being equal to or smaller than 0.95.

4. The multi-band patch antenna module according to claim 1, wherein the inner radiation patch is formed with a feeding hole, and the feeding hole is formed to be spaced from a center point of the inner radiation patch.

5. The multi-band patch antenna module according to claim 4, wherein the dielectric layer is formed with another feeding hole on a location corresponding to the feeding hole, which is formed on the inner radiation patch.

6. The multi-band patch antenna module according to claim 1, wherein the outer radiation patch is the frame shape having the same horizontal length and vertical length.

* * * * *